United States Patent [19]

Comisar et al.

[11] 3,944,788

[45] Mar. 16, 1976

[54] VOTE-RECORDING APPARATUS

[75] Inventors: Gerald G. Comisar, Los Angeles; Fred L. Carter, Torrance, both of Calif.

[73] Assignee: Compuvote Corporation, Beverly Hills, Calif.

[22] Filed: Jan. 27, 1975

[21] Appl. No.: 544,195

[52] U.S. Cl. ..... 235/54 F
[51] Int. Cl.² ..... G07C 13/00
[58] Field of Search ..... 235/51–56

[56] References Cited

UNITED STATES PATENTS

| | | | |
|---|---|---|---|
| 3,630,434 | 12/1971 | O'Neal | 234/116 |
| 3,881,092 | 4/1975 | O'Neal et al. | 235/54 R |

*Primary Examiner*—L. T. Hix
*Assistant Examiner*—Vit W. Miska
*Attorney, Agent, or Firm*—Fulwider, Patton, Rieber, Lee & Utecht

[57] ABSTRACT

Apparatus for simultaneously punching a ballot card, to produce a permanent voting record, and generating corresponding electrical signals for use in an electronic balloting system, the apparatus including an electrical contact matrix having a plurality of column contact strips and a plurality of row contact strips, and further including a hand-held stylus which is insertable through holes in the matrix to punch a ballot card held adjacent to the matrix. The stylus has a punch-rod and first and second contact sleeves slidingly mounted with respect to the punch-rod, the contact sleeves being urged by springs into contact with respective column and row strips, to make electrical contact between a column strip and a row strip as the ballot card is punched. An electronic interface connected with the contact matrix detects each contact completed, and generates signals indicative of the row and column punched in the ballot card.

18 Claims, 7 Drawing Figures

VOTE-RECORDING APPARATUS

BACKGROUND OF THE INVENTION

This invention relates generally to electronic balloting or vote-recording systems, and, more particularly, to such systems which also utilize punched cards as permanent ballot records.

Governmental agencies have long sought a reliable and rapid system for recording and tallying the ballots of voters on election day. With increasing population and a seemingly ever-expanding list of offices and issues to be voted upon, an effective and convenient solution has still to be found, in spite of the availability of fast and reliable electronic computers.

Apart from manual counting methods, there are basically three vote-counting techniques presently available: those utilizing punched or otherwise encoded cards, mechanical voting machines, and electronic voting machines. In a punched-card system, each voter records his selections by punching holes, using a hand-held stylus of some kind, in a card which is placed in a specially designed holder so that the hole locations are properly aligned with the possible voter selections, which are printed in a booklet attached to the holder or printed on the card itself. The punched-card form is a convenient one because it is also a standard input medium for electronic computers. Consequently, the cards can be transported to a computer site, and read into a computer system for tallying and printing of the election returns.

However, the punched-card system suffers from a number of serious disadvantages. First, the cards must be handled manually by a number of people in passing from the voters' hands to the computer. This not only introduces an unavoidable security hazard, but also results in a substantial time delay in generating the complete election returns. Furthermore, the cards have to be manually "manicured" to ensure that the punched-out material is completely removed before the cards are passed through card reading machines. Even when all possible care is taken, a small but not insignificant percentage of cards will usually be virtually destroyed by card jams in the reading machines.

Mechanical vote-recording machines are generally more reliable, in the sense that they accurately indicate the voter selections. However, a system utilizing mechanical voting machines at each precinct depends on the accurate transcribing of the machines' tallies, and there is much room for human error in transferring these tallies to a central computer, not to mention the security hazard entailed. Furthermore the mechanical counters register only running tallies, and lack an audit trail for use in the case of a vote recount.

Completely electronic machines appear to be the ideal solution to the problems of mechanical and punched-card systems. It is within the current state of the electronics art to design a voter terminal employing only electrical switches for voter selections, to store and transmit these selections to a central computer over telephone lines or by other means, and to process the voter selections in the computer, all without human intervention. Thus, the problem of manual card-handling, time delays, and security hazards are all avoided by the totally electronic system. One significant problem remains, however.

As in the case of mechanical vote-recording machines, a totally electronic system would provide no permanent, i.e., non-volatile, record of each ballot cast. A recount procedure would not be possible except by rerunning the central computer through its computations, a procedure which would not, of course, detect possible errors introduced in the transmission of the data. Raw data as provided by the voter could not be reproduced, at least not without some intervening electronic processing. Basically, then, the disadvantages of totally electronic balloting systems stem from their lack of reliance on permanent voting records. It seems that the reliability of totally electronic systems is still suspect to some degree, and some form of back-up, incorporating elements of an already proven technique, is necessary if the systems are to be widely accepted.

It will be appreciated from the foregoing that there is definite need in this art for a system incorporating apparatus which provides the speed and reliability of a totally electronic balloting system, but which is conveniently compatible with existing systems, and which gererates permanent records, such as punched cards, encoded with the raw balloting data at each balloting site. The present invention fulfills this need.

SUMMARY OF THE INVENTION

The present invention resides in the novel combination of a hand-operated ballot-recording device, such as a card punch, and an electrical sensor matrix means having a plurality of elemental sensors for detecting the voter selections. The sensor matrix means is connectable to an electronic processor located in the precinct office and utilized to automatically tally and format the vote selections, and to forward them to a central computer, preferably over a communication link such as a telephone line. The novel combination, therefore, provides for the simultaneous generation of electrical signals indicative of each voter selection, and a conventional machine-readable ballot, such as a punched card, as a permanent record of each voter's selections.

Basically, and in general terms, the apparatus of the present invention includes means for holding a ballot card for encoding or punching, the electrical sensor matrix means located adjacent to the ballot card, portable stylus means engageable with the electrical matrix means to actuate it at a selected elemental sensor, and having card-punching means to simultaneously perforate the card, and electrical interface means connected with the electrical sensor matrix means, for generating encoded electrical signals indicative of the voter selections.

In accordance with a presently preferred embodiment of the invention, the electrical sensor matrix means comprises a plurality of electrical contacts, including a plurality of row contact strips and a plurality of column contact strips, all insulated from one another. The stylus means is inserted through perforations in the contact strips to make an electrical contact between one row and one column strip, and to simultaneously punch the ballot card.

More specifically, the stylus means of the presently preferred embodiment includes a central punch-rod, an outer stylus body rigidly connected to the punch-rod, two contact sleeves surrounding the punch-rod and sized to contact the row and column contact strips, respectively, and resilient means mounted between the contact sleeves and the stylus body, so that, as the punch-rod is pushed through the card by force applied to the stylus body, the resilient means force the two contact sleeves into contact with the row and column strips, respectively, to make an electrical contact between them. The column and row connection thus completed by the stylus is then sensed by the electrical interface means connected to the row and column contact strips, and encoded signals indicative of the row and column selections are generated for utilization by the local electronic processor.

The electrical interface means in the aforementioned preferred embodiment includes scanning means for cyclicly scanning the points of the matrix until a connection between a row connector strip and a column connector strip is detected, means operable to temporarily disable the scanning means when a connection on the matrix is found, means for transmitting for tallying the row and column numbers indicative of the connection, and means for reactivating the scanning means.

The voter terminal also includes a "vote complete" switch, which is normally actuated by the voter after all his ballot selections have been made, and a ballot sense switch, which senses the presence of a ballot card in the terminal. With the condition of these two switches and the encoded row column data at its disposal, the local processor, which may be a hard-wired unit, or a programmable minicomputer or microprocessor, can readily tally and format the voter selection data for local storage and subsequent transmission to a central computer.

It will be appreciated from the foregoing that the present invention overcomes a major obstacle to the implementation of electronic balloting systems, in that it provides for the generation of electrical signals simultaneously with the punching of a ballot card as a permanent or back-up record of the voter selections. Furthermore, the manual voting procedure resembles quite closely that of the existing punched card voting procedure. Other aspects and advantages of the invention will become apparent from the following more detailed description taken in conjunction with the accompanying drawings.

DESCRIPTION OF THE PREFERRED EMBODIMENT

Figure 1:
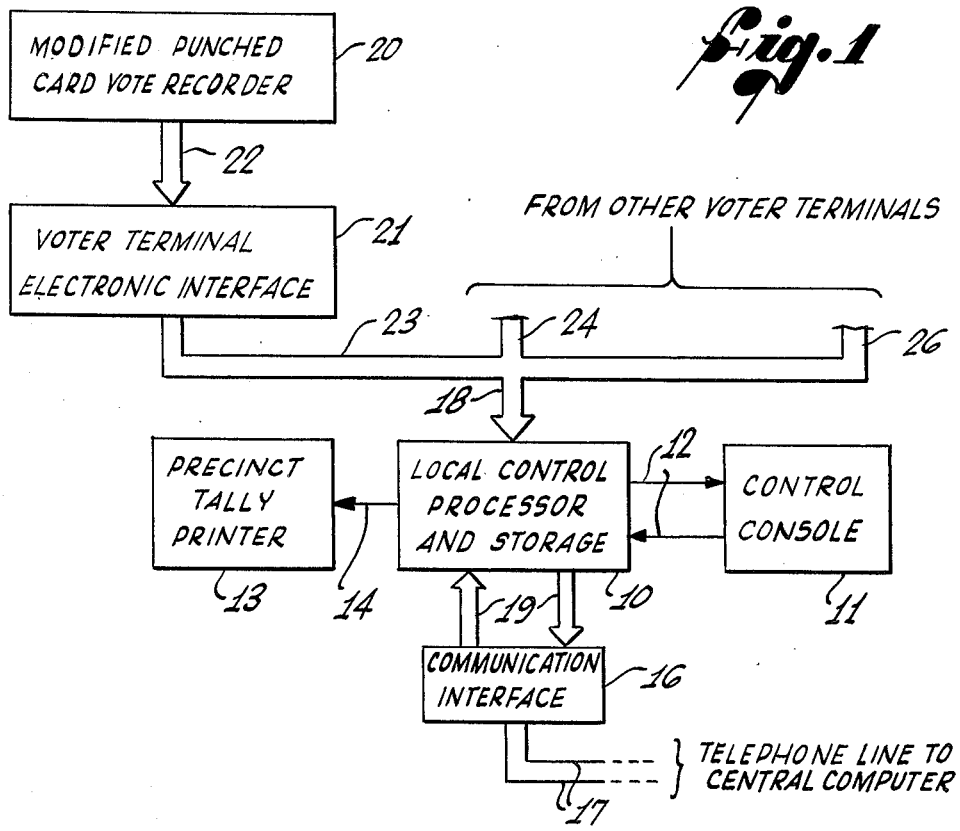
FIG. 1 is a block diagram of an electronic balloting system embodying the apparatus of the present invention.

As shown in the drawings for purposes of illustration, and as best shown in FIG. 1, the present invention is incorporated into an electronic balloting system which also utilizes punched cards as a vote-recording medium. The equipment at each precinct or polling place in such a system normally includes a local control processor and storage device, indicated by the reference numeral 10, an associated control console 11, shown connected with the processor by control lines 12, and, optionally, a precinct tally printer 13, which receives data for printing over line 14 from the processor.

The control processor 10 may be a hard-wired electronic device, or may be a programmable computer or microprocessor, and is preferably connected to a central computer (not shown), through a communication interface 16 such as an acoustic coupler or a modulator/demodulator, and a communication link such as a telephone line 17. The processor 10 receives the voter selections as input data, as indicated by the data paths 18 in FIG. 1. The processor 10, appropriately stores, tallies, and formats data relating to ballot selections, and can send and receive data to and from the central computer, as indicated by the paths 19, so that local accumulations of ballots can be transmitted to the central computer for processing. For increased security of the transmitted data, various data scrambling and encoding techniques well known in the electronic communications art may be employed. For increased accuracy, error-correcting codes, likewise well known in the art, may be added.

Electronic balloting systems as thusfar described are well within the current state of the electronics art, and no detailed description of the control processor 10, control console 11, precinct tally printer 13, and communication interface 16, is believed to be necessary, since they form no part of the present invention. Although electronic balloting systems are faster and generally more reliable than other vote-recording techniques, they have not been widely accepted, principally because they are unfamiliar to voters and they provide no means to recover the original ballot selection data in the event of an electrical failure of some kind, or if a vote recount is needed.

In accordance with the present invention, the voter selections are simultaneously recorded electrically for use by the electronic balloting system, and mechanically, in the form of conventional punched-card ballots. Thus, in the event of an electronic malfunction of the local control processor 10, the central computer, or of any component comprising the communication link between them, or if a vote recount is required, the punched-card ballots can be read into the central computer in much the same manner as they are in some present-day balloting systems.

The apparatus of the present invention includes a conventional punched-card vote recorder 20, modified as will shortly be described, and a voter-terminal electronic interface 21 connected with the vote recorder to receive ballot data therefrom, as shown diagrammatically by the data path 22. As a voter makes his selections, they are recorded as perforations or holes in a conventional punched card, and electrical signals indicative of the selections are simultaneously generated in the modified vote recorder 20, acting in conjunction with the electronic interface 21, and transmitted to the control processor 10 over data paths 23 and 18. As is usual with electronic balloting systems, there are similar paths, indicated by the numerals 24 and 26, from other voter terminals at the same site, so that voting may proceed virtually simultaneously at a plurality of voter terminals.

Figure 2:
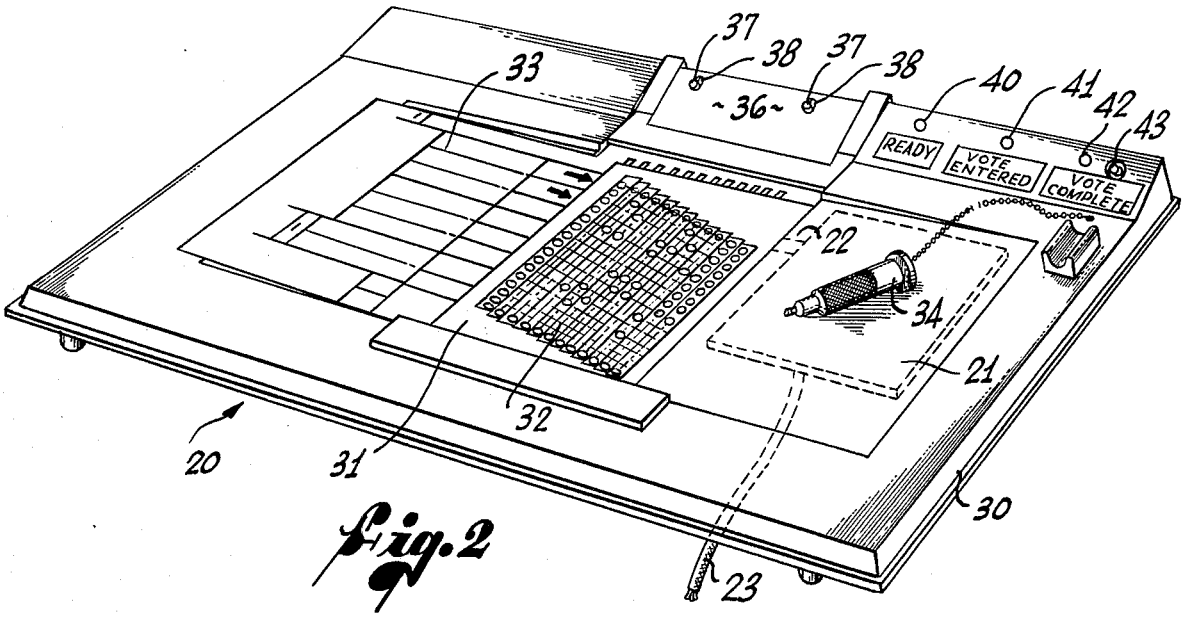
FIG. 2 is a perspective view of a modified punched-card vote-recorder incorporating features of the present invention.

As shown in FIG. 2, the modified punched-card vote recorder 20 is physically similar, in many respects, to a conventional punched-card vote recorder. The modified recorder 20 has a generally flat base 30 on which is mounted a flat plate 31, usually centrally located on the base and having a matrix of holes 32 therein arranged in rows and columns. As is conventional, a multi-page ballot booklet, only one page of which is shown (at 33), is provided to indicate to the voter which holes in the matrix 32 correspond to the various ballot selections. The pages are usually hinged separately, so that, as each page of the booklet is turned, a different column of holes in the matrix 32 is uncovered. Each possible voter selection on a particular page has corresponding holes in the exposed column, and the voter makes his selections by inserting a hand-held stylus 34 into the appropriate holes of the matrix 32. As is also conventional, a ballot card 36 is inserted by each voter behind or under the plate 31 and is held in a correct position by means of two pins 37 which project upwardly from the base through two corresponding holes 38 in the card. As the voter makes his selections, perforations in the card 36 are punched out to record the selections.

Figure 3:
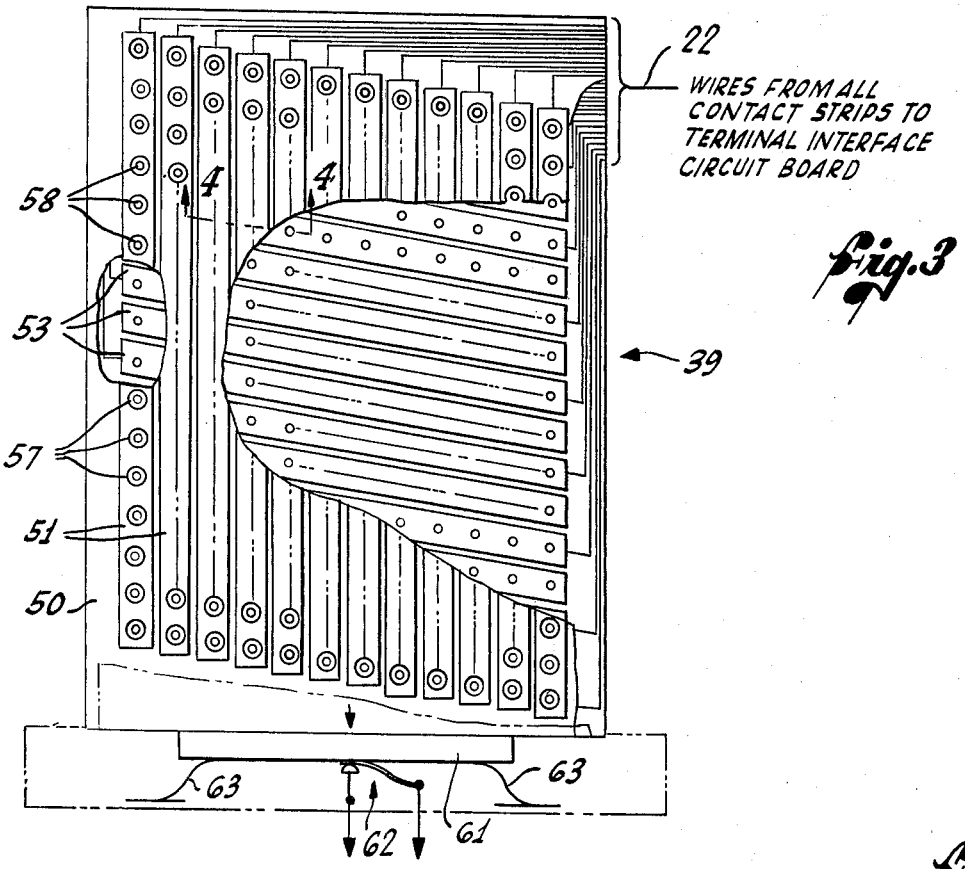
FIG. 3 is an enlarged, plan view of an electrical contact matrix utilized in the vote-recorder of FIG. 2, with portions partially broken away to show row and column contact strips in the matrix.
Figure 5:
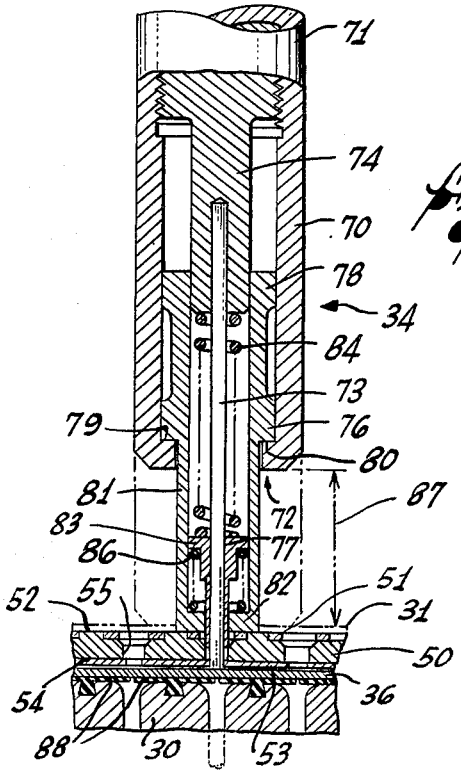
FIG. 5 is an enlarged cross-sectional view of the hand-held vote-recording stylus which was shown only generally in FIG. 2, here shown inserted in the matrix of FIG. 3, but with the stylus body not yet depressed.
Figure 4:
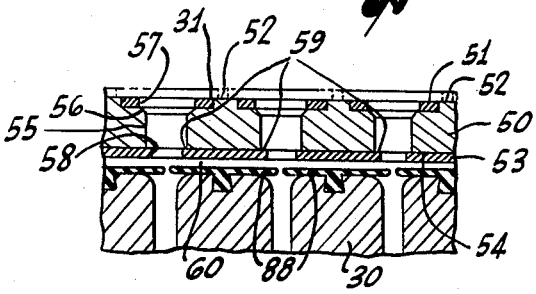
FIG. 4 is a further enlarged, fragmentary, cross-sectional view of the matrix of FIG. 3, taken substantially along the line 4—4.
Figure 5A:
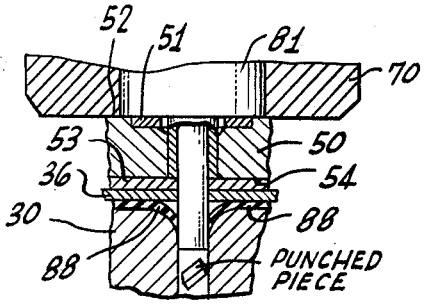
FIG. 5*a* is a further enlarged, fragmentary view of the stylus of FIG. 5, shown with the stylus body fully depressed and the punch-rod fully extended.

Unlike conventional card-punching vote recorders, however, the modified recorder 20 has an electrical contact matrix 39, not visible in FIG. 2 but shown in detail in FIGS. 3 and 4, and the stylus 34 is of novel design, as illustrated in FIGS. 5 and 5a, to allow the simultaneous punching of the card 36 and generation of corresponding electrical signals. The modified recorder 20 also has three indicator lights 40–42, and a control button 43, the nature of which will be explained below, all mounted on the base 30 of the recorder, and has the electronic interface 21 mounted under the base 30, as shown in outline in FIG. 2.

As shown in FIGS. 3 and 4, the electrical contact matrix 39 mounted beneath or integral with the plate 31 consists of an insulated board 50 of any convenient insulating material, such as LUCITE, a plurality of parallel column contact strips 51, recessed into the upper face 52 of the insulated board 50, and a plurality of parallel row contact strips 53, recessed into the lower face 54 of the board. The strips 51 and 53 are of uniform and substantial width and may be made of copper or any other suitable electrically conductive material. In accordance with one standard punched-card format often used for ballot cards, there are sixteen rows and twelve columns, and the rows are slanted, i.e., not at right-angles with the columns. Of course, it will be understood that the invention is not limited to this illustrative format.

At those areas of the board 50 overlapped by both a row contact strip 53 and a column contact strip 51, the board is perforated by holes 55 which have a tapered portion 56 and are larger in diameter at the upper face 52 of the board. The column contact strips 51 have a plurality holes 57 therethrough, the latter being aligned with, and of the same upper-face diameter as the holes 55 in the board 50. The row contact strips 53 also have a plurality of holes 58 therethrough, but these are of slightly smaller diameter than the lower-face diameter of the holes 55, so that the row contact strips form an annular ledge 57 at the bottom of each hole 55 through the insulated board 50. It will be appreciated that the holes 55, 57 and 58 are aligned with corresponding holes in the vote selection matrix 32, and that the terms "column" and "row" are used arbitrarily herein for purposes of description, and could be interchanged without departing from the invention.

As is explained in detail below, the stylus 34 is used by the voter to make a momentary electrical contact between one of the row contact strips 53 and one of the column contact strips 51. Individual electrical connections with each of the contact strips 51 and 53 are established by a bundle of insulated conductors indicated by reference numeral 22.

The board 50 and contact strips 51 and 53 are mounted directly beneath, or are integral with, the vote selection matrix 32. As best seen in FIGS. 4 and 5, there is a slot or space 60 immediately beneath the lower face 54 of the board 50, to allow for insertion of the ballot card 36. When the card 36 is positioned as shown in FIG. 2, one edge of the card, the leading edge as the card is inserted, contacts and depresses a pusher block 61 (FIG. 3) mounted on the base 30. The pusher block 61, in turn, closes a ballot sense switch 62, thus electronically indicating the presence of the card. The ballot sense switch 62 and the pusher block 61 are both spring-loaded. When the card 36 is removed by lifting it from the pins 37, leaf springs 63 and 63 lift the pusher block 61 and allow the switch 62 to open.

The novel stylus 34 employed in the present invention includes, as shown in FIGS. 5 and 5a, a generally cylindrical hollow outer body 70, having a closed end 71 and an open end 72, and further includes a central punch-rod 73 rigidly secured to the outer body 70 by means of center-post 74 which is formed integrally with one end of the punch-rod and is threadably secured to the closed end 71 of the body 70. Therefore, the stylus 34 as thusfar described, comprises the cylindrical outer body 70, the center-post 74 extending inwardly into the body from the closed end 71, and the punch-rod 73 extending further from the center-post and out through the open end 72 of the body. Two of these components, the outer body 70 and center-post 74, may be of molded plastic construction, for lightness and economy of manufacture. The punch-rod 73 may be of any hard electrically insulating material, such as anodized aluminum or fiber glass.

Mounted for sliding movement with respect to the punch-rod 73 and body 70 are an outer contact sleeve 76 and an inner contact sleeve 77, both made from or coated with electrically conductive material. The outer contact sleeve 76 has an inner diameter sized to slidingly engage the center post 74, and has a piston-like end 78 sized to slide in the annular gap formed between the center-post 74 and the outer body 70. An inwardly projecting annular lip 79 on the open end 72 of the body 70 prevents the outer contact sleeve 76 from withdrawal from the body 70, since an annular shoulder 80 on the sleeve 76 abuts the annular lip as the outer contact sleeve 76 is extended. The annular shoulder 80 defines a diameter reduction in the outer contact sleeve 76 which has a reduced-diameter cylindrical portion 81 extending through the open end 72 of the body 70 and terminating in an annular, inwardly-projecting lip 82 which is utilized to contact the column contact strips 51.

The inner contact sleeve 77 has an inside diameter which slidingly engages the punch-rod 73, a piston-like flange 83 on one end which slides inside the cylindrical portion 81 of the outer contact sleeve 76, and an outer sleeve diameter sized so that the inner contact sleeve can slidingly project through the annular lip 82 on the end of the outer contact sleeve, and can be inserted in one of the holes 55 to make electrical contact with one of the row contact strips 53.

Completing the stylus 34 are two coiled compression springs, an upper spring 84 and a lower spring 86. The upper spring 84 encircles the punch rod 73 and abuts the center-post 74 with one end and the flanged end 83 of the inner contact sleeve 77 with the other. The lower spring 86 encircles the inner contact sleeve 77 and abuts the flanged end 83 of the inner contact sleeve with one end, and the inner annular lip 82 of the outer contact sleeve 76 with the other. The springs 84 and 86 are selected so that, if the stylus 34 is placed in one of the holes 55 but no downward pressure is applied, then the combined action of the two springs will force the outer contact sleeve 78 to a fully extended position, i.e., with the shoulder 80 abutting the annular end 79 of the body, but the innercontact sleeve 77 will not be fully extended.

In essence, the punch-rod 73 is a retractable element, and, when not being used, it is held in a retracted position with only a small end portion projecting from the outer contact sleeve 76. The punch-rod 73 is extended by the application of a force on the outer body 70, a downward force as viewed in FIG. 5, while an equal upward force is applied to the outer sleeve 76 via the annular lip 82.

In operation, the stylus 34 is placed on one of the holes 55, and the outer body 70 is depressed to the position shown in FIG. 5*a*. The springs 84 and 86 act to urge the outer contact sleeve 76 into electrical contact with the appropriate column strip 51, and to urge the inner contact sleeve into electrical contact with the ledge 59 formed by the appropriate row contact strip 53. Since the outer sleeve 76 and the inner sleeve 77 are in sliding contact with each other, and are both in contact with the second spring 86, the row and column contact strips 53 and 51 are electrically connected by this action. As the outer body 70 moves through its strokes, indicated by the arrow at 87 in FIG. 5, the lower spring 86, which acts in opposition to the upper spring 84, in the sense that the lower spring 84 urges the inner contact sleeve 77 inwardly with respect to the outer contact sleeve 76, is gradually compressed by the upper spring 84, so that the inner contact sleeve moves through a shorter stroke until it contacts the ledge 59. This stroke of the inner contact sleeve 77 eliminates the possibility of electrical contact being made without movement of the body 70, and without punching of the card 36.

Simultaneously with movement of the outer body 70, the punch-rod 73 moves with the outer body and perforates the card 36. As is usual with hand-operated card punches of this type, the card 36 is supported from beneath by a plurality of stiff but bendable sheets 88, usually of rubber or similar material, mounted in the base 30. The strips are arranged to abut beneath the holes 55, and they operate to more positively remove each punched piece of card, as shown in FIG. 5a.

It should now be clear how manipulation of the stylus 34 effects an electrical contact between the row and column contact strips corresponding to the selected hole in the matrix 32 (FIG. 2). This electrical contact can be detected by any convenient interface means, for ultimate use by the local control processor 10 (FIG. 1). For example, if the electronic interface 21 (FIG. 1) of the presently preferred embodiment were not used, it could instead be arranged that the stylus 34 be electrically grounded, so that the selected row and column contact strips would also be grounded by operation of the stylus. A row encoder and a column encoder could then convert the selection to row and column numbers for periodic monitoring by the control processor 10. The electronic interface 21 of the presently preferred embodiment is believed to be an advantageous one, however, and to be easily connectable with any form of control processor 10, whether it be a hard-wired deivce or a programmable computer or microprocessor.

Figure 6:
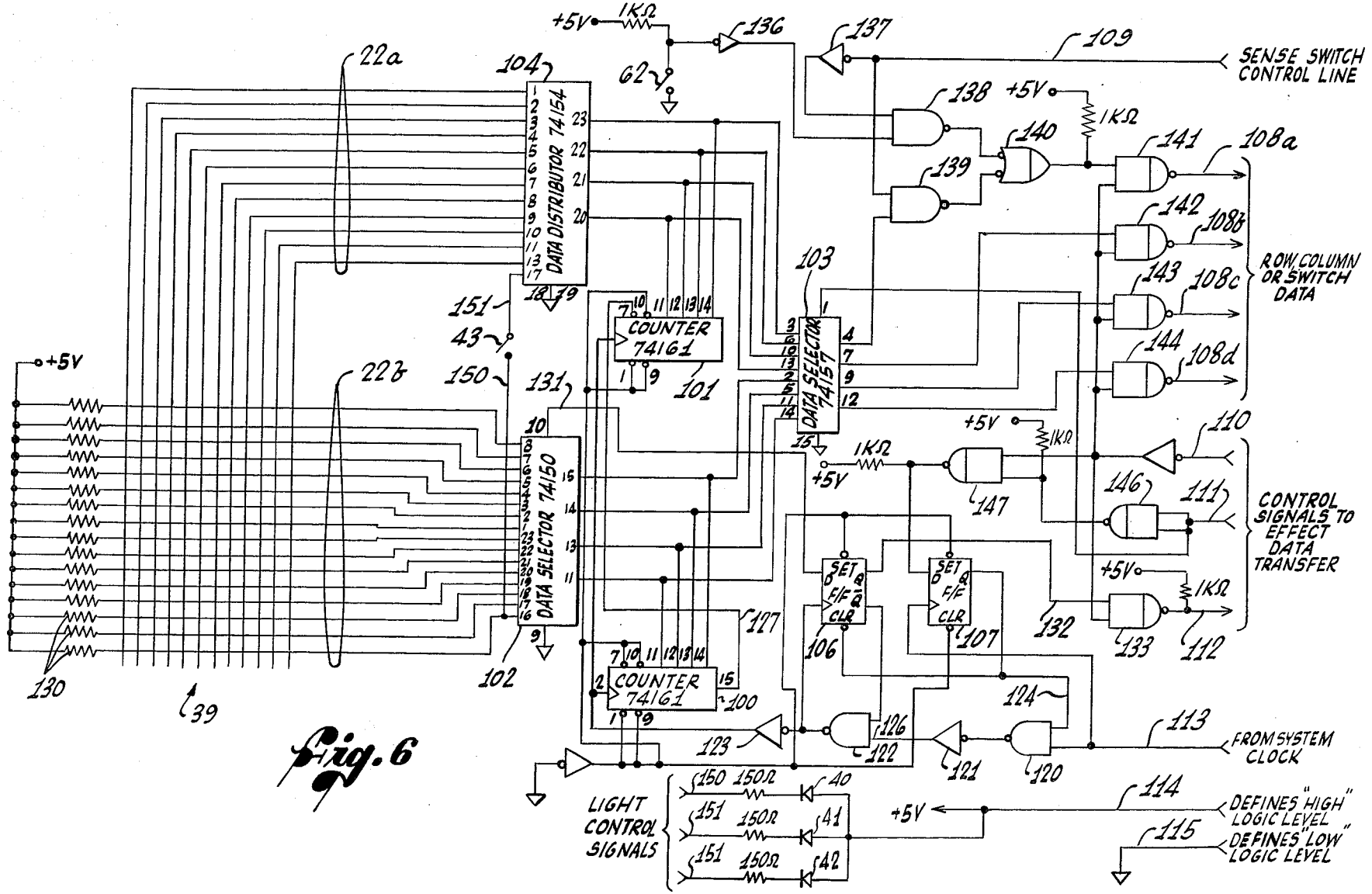
FIG. 6 is an electrical schematic diagram of the voter terminal electronic interface shown in FIG. 1, here shown connected with the connection matrix of FIG. 3.

The electronic interface 21 (FIG. 1) is illustrated in detail in FIG. 6. It employs transistor-transistor logic (TTL) integrated circuit chips, all of which are commercially available from various manufacturers, and the part numbers of which are provided herein. The interface includes two cascaded binary counters 100 and 101, a one-of-sixteen data selector 102, a one-of-two data selector 103, a one-of-sixteen data distributor 104, two D-type flip-flops 106 and 107, and a number of miscellaneous gates, inverters and discrete resistors which will be introduced as this description proceeds.

Connection with the electrical contact matrix 39 is made by lines 22*a* from the column contact strips 51 (FIG. 3) to the data distributor 104, and lines 22*b* from the row contact strips 53 (FIG. 3) to the data selector 102. Connection with the control processor 10 (FIG. 1) is effected by data lines 108*a*–108*d*, and control lines 109–112. The control processor 10 (FIG. 1) also supplies system clock pulses on line 113 and "high" and "low" logic levels on lines 114 and 115, respectively.

In general terms, what happens when a voter completes an electrical contact between a row and a column strip is that the electronic interface detects that the control has been made, and signals the control processor 10 (FIG. 1) that data is available. The processor 10 (FIG. 1) then reads the row and column data, or data relating to settings of the ballot sense switch 62 or vote-complete switch 43, over the data lines 108*a*–108*d*. When the data has been transferred, the interface begins scanning for a new row-column contact.

More specifically, the binary counters 100 and 101 are each four-bit counters driven by clock pulses received over line 113 through a logic chain consisting of a first NAND gate 120, an inverter 121, a second NAND gate 122, and another inverter 123. The first NAND gate 120 receives as one input clock pulses over line 113 from the system clock, and has the Q output signal of flip-flop 107 as its other input, on line 124. The second NAND gate 122 receives one input on line 126 from the first NAND gate 120, through the inverter 121, and has as its other input the $\overline{Q}$ output of the other flip-flop 106. Consequently, for clock pulses to pass through both of the NAND gates 120 and 122, flip-flop 107 has to be in the on condition and flip-flop 106 has to be in the off condition.

Binary counter 100 has its carry signal connected to an enabling circuit of the other binary counter 101, over line 127. Thus, the two counters 100 and 101 together make up an eight-bit counter, with counter 100 counting the four least significant binary digits, and therefore operating at a rate sixteen times faster than that of counter 101. At any instant, the contents of counter 101 indicates a column number, and the contents of counter 100 indicates a row number. The column number from counter 101 is connected to the selection inputs of the one-of-sixteen data distributor 104, the output lines of which are connected, by lines 22*a*, to the column contact strips 51 (FIG. 3). Similarly the row number from counter 100 is connected to the selection inputs of the one-of-sixteen data selector 102, the data inputs of which are connected, by lines 22*b*, to the row contact strips 53.

The data distributor 104 applies a low logic level, in this case at ground potential, to each of the column strips 51 in turn, as selected by the column counter 101, and the data selector 102 scans the row contact strips 53 for a low logic level. If none is found, the column counter 101 advances to the next column and the scan continues, repeating its cycle indefinitely if no electrical contact is established between a row strip 53 and a column strip 51.

As has been described, when a ballot selection is made, electrical contact is made between a row strip 53 and a column strip 51. Each of the row strips 53 is normally held at a high logic level by a positive voltage applied through one of a plurality of pull-up resistors 130. Consequently, when a low or ground level is applied to the selected column strip by the data distributor 104, the low level is also transmitted to the selected row strip, but the other row strips are held at a high level by the pull-up resistors 130.

When scanning the rows and columns, as controlled by the counters 100 and 101, results in the detection of a row-column connection, the data selector 102 generates a high logic level on its output line 131. As will now be described, in detail, this has the effect of stopping the counters 100 and 101, thereby preserving the row count in counter 100 and the column count in counter 101, for subsequent interrogation by the local control processor 10 (FIG. 1), and also has the effect of setting up a control signal or flag to advise the processor that ballot data is available at this particular voter terminal.

The output signal from the data selector 102 on line 131 is connected to the D input of flip-flop 106. Thus, the next time that this flip-flop 106 is clocked, it will be switched to the on condition, in which its Q output is high and its $\overline{Q}$ output is low. As was described eearlier, the $\overline{Q}$ output of the flip-flop 106 is connected as in input to NAND gate 122. Consequently, a low level on this $\overline{Q}$ output will result in the clock signals being blocked by NAND gate 122, thus stopping the counters 100 and 101.

At this point in the operation of the interface logic, the selected row and column counts have been preserved in the counters 100 and 101, and the control processor 10 (FIG. 1) must read these values and start the counters again so that the next ballot selection can be detected. The transfer of data over lines 108*a*–108*d* to the control processor 10 (FIG. 1) is effected by proper manipulation of the control lines 109–112 from the processor, the functions of which will now be more specifically described.

Control line 110 transmits a low logic level from the processor 10 (FIG. 1) when this particular terminal is being serviced or interrogated by the processor. It will be appreciated that the processor 10 (FIG. 1) will normally have to service a plurality of voter terminals, and some means must, therefore, be provided for it to time-share its operations among the several terminals. Control line 110 serves this purpose.

Control line 112 is the flag indicating that row and column data are available at this terminal. It will be noted that the Q ouput from flip-flop 106 is connected by line 132 as an input to another NAND gate 133, the other input of which is derived from the inverse of the signal on control line 110. Thus, the logic level on line 112, which is the output from NAND gate 133, will be low when data is available, as determined by flip-flop 106 being switched on, and the processor is servicing this terminal. Control line 112 will be high otherwise, indicating to the processor that no data is presently available at this terminal.

Control line 111 is a row-column selection line. Since, for reasons of economy, only four data lines 108*a*–108*d* are utilized, only row or column data may be transmitted at a given time. Line 111 is set high by the processor when column data is requested, and low when row data is requested. It is reset to the high level again after the row data has been read.

Finally, control line 109 allows the status of the sense switch 62 to be transmitted over data line 108*a*. When line 109 is set low, line 108*a* represents the status of the sense switch 62. Line 108*a* is then high when the sense switch 62 is open, and is low when the sense switch is closed, indicating the presence of a ballot card. So long as control line 109 is held high, data line 108*a* indicates one bit of the inverse row or column count. The logic whereby the status of the control line 109 effects the selection of signals for data line 108*a* includes two inverters 136 and 137 and three NAND gates 138, 139 and 140, the last of which is indicated in FIG. 6 as an equivalent OR gate with inverted inputs. Since this logic is not critical to the invention as claimed, it will not be described in detail. Its operation may be easily verified by inspection and analysis of the relevant portions of FIG. 6.

The one-of-two data selector 103 is more properly a four-of-eight data selector, since it selects as its outputs either the row count from counter 100 or the column count from counter 101, according to whether control line 111 is low or high. The four outputs from the data selector 103 are connected to data lines 108*a*–108*d* through NAND gates 141–144, respectively, each of which has as its other input the inverse of the signal on control line 110. Thus when control line 110 is held low, the data lines 108*a*–108*d* are set to the inverse values of the selected row or column count. The control line 111, which, it will be recalled, is used to select row or column data, is also connected through two further NAND gates 146 and 147 to the D input of the flip-flop 107, so that, when row data is selected by making line 111 low, the D input of this flip-flop is also forced low, and the flip-flop 107 is switched to the off condition. The effect of this will become clear in the ensuing description of the operation of the logic as data is read by the control processor 10 (FIG. 1).

As has been described in detail, when a row-column contact is detected by the scanning operation of the data distributor 104 and data selector 102, the selected column and row counts are preserved in the counters 100 and 101, respectively, and the clock pulses are blocked by the on condition of flip-flop 106. At this point, the following steps have to be performed to transfer the row and column data from the counters 100 and 101;

a. Control line 110 is set low to obtain access to this terminal.

b. Control line 112 is checked to determine if data is available.

c. Column data is read on data lines 108*a*–108*d*.

d. Control line 111 is set low to read row data on lines 108*a*–108*d*. This also has the effect of switching flip-flop 107 off, which, in turn, switches flip-flop 106 off, unblocking the clocking signals at NAND gate 122. However, switching flip-flop 107 off also simultaneously blocks the clocking signals at NAND gate 120.

e. Control line 111 is set high again after the row data has been read. This has the effect of switching flip-flop 107 on again, and thereby unblocking the clocking signals at NAND gate 120, so that the counters 100 and 101 will begin scanning the rows and columns for another row-column connection.

As is apparent from FIG. 6, the vote-complete switch 43 is connected to one row connector, by line 150, and is also connected, by line 151, as a fictitious column connector to the data distributor 104. Thus, the status of the vote-complete switch 43 is available to the control processor 10 (FIG. 1) as a fictitious but identifiable row-column connection. The status of the ballot sense switch 62 can, as has been explained, be detected by the control processor 10 (FIG. 1) by setting control line 109 low momentarily and reading the signal impressed on data line 108*a*.

Ideally, each phase of the above-described operations should be indicated to the voter by some form of display device, such as the indicator lights 40, 41 and 42, which may be light-emitting diodes. The indicator light 40 is a ready light, which is illuminated when the terminal is ready to accept ballot selections. The indicator light 41 provides a vote entered indication, acknowledging the receipt of each selection. The indicator light 42 provides a vote-complete indication when all of the selections of a voter have been added to a local tally, after the voter momentarily closes the vote-complete switch 43. The indicator lights 40–42 are actuated by applying a low logic level to lines 150–152, respectively.

In summary, the electronic interface illustrated in FIG. 6, automatically scans for completed row-column connections and transmits them to the control processor 10 (FIG. 1) under the direction of control signals on lines 109–112. The ballot sense switch 62 may be continually checked by the control processor, to verify that a ballot card is still present. If the ballot card is removed before the vote-complete switch 43 is actuated, it can be arranged that the votes as thusfar entered are not added to the local tally. This provides a means for letting the voter start afresh with a new card if he makes an error in entering his selections.

The standard part numbers of the logic components used in the embodiment of the interface illustrated in FIG. 6 are as follows: 74150 for the data selector 102, 74154 for the data distributor 104, 74161 for the counters 100 and 101, 74157 for the data selector 103, 7474 for the flip-flop 106 and 107, 7404 for the inverters, 7400 for the NAND gates 120, 122, 138 and 139, and 7403 for the NAND gates 133, 140–144, 146 and 147.

It will be appreciated from the foregoing that the present invention provides a hitherto unavailable means for simultaneously producing punched-card ballot records and corresponding electrical signals which may be conveniently utilized by digital equipment used to tally the votes. The invention therefore allows the advantageous use of reliable electronic ballot counting equipment, while still retaining conventional punched-card records for possible use as a back up or in recount procedures.

It will also be appreciated that, although a particular embodiment of the invention has been described in detail for purposes of illustration, various modifications may be made without departing from the spirit and scope of the invention. Accordingly, the invention is not to be limited, except as by the appended claims.

We claim:

1. For use in an electronic balloting system, vote-recording apparatus for simultaneously providing a permanent, machine-readable record of each ballot and electrical signals indicative of voter selections, said apparatus comprising:

means for holding a ballot record for encoding thereon the voter selections;

electrical sensor matrix means located adjacent the ballot record and having a plurality of elemental sensors corresponding to available ballot selections; and portable stylus means engageable with said electrical matrix means to selectively actuate same at a particular elemental sensor, thereby producing an electrical signal indicative of a voter selection, said stylus means having ballot record encoding means for simultaneously encoding on the ballot record a voter selection corresponding to said actuated elemental sensor of said electrical matrix means.

2. For use in an electronic balloting system, vote-recording apparatus for simultaneously producing punched holes in a ballot card and electrical signals indicative of voter selections, said apparatus comprising:

means for holding a ballot card for punching;

electrical sensor matrix means located adjacent the ballot card, and having a plurality of elemental sensors corresponding to available ballot selections;

portable stylus means engageable with said electrical matrix means to actuate same at a selected elemental sensor, and having card punching means for simultaneously punching a portion of the ballot card corresponding to the ballot selection and to said acutated elemental sensor of said electrical matrix means; and electrical interface means connected with said electrical sensor matrix means, for generating therefrom encoded electrical signals indicative of the ballot selection.

3. Vote-recording apparatus as set forth in claim 2, wherein said elemental sensors in said electrical sensor matrix means comprise pairs of electrically conductive contacts.

4. Vote-recording apparatus as set forth in claim 2, wherein said electrical sensor matrix comprises:

an insulated board approximetely equal to the size of the ballot card;

a plurality of parallel conductive column strips affixed to one face of said board; and a plurality of parallel conductive row strips affixed to the other face of said board;

and wherein said board and said strips are perforated by holes at points corresponding to areas of overlap of said column strips and said row strips.

5. Vote-recording apparatus as set forth in claim 3, wherein:

said elemental sensors are arranged in rows and columns; and corresponding contacts of said pairs of electrically conductive contacts are electrically connected in rows and in columns, whereby actuating one of said elemental sensors results in making electrical contact between one row of said contacts and one column of said contacts.

6. Vote-recording apparatus as set forth in claim 4, wherein said stylus means includes:

first contact means for contacting a corresponding one of said column strips as said stylus means is inserted in a selected one of said holes;

second contact means for contacting a corresponding one of said row strips as said card punching means is operated to perforate the ballot card, said first and second means being electrically connected, whereby an appropriate pair of said column and row strips is electrically connected as the ballot card is punched.

7. For use in an electronic balloting system, vote-recording apparatus for simultaneously producing punched holes in a ballot card and electrical signals indicative of voter selections, said apparatus comprising:

means for holding a ballot card for punching;

electrical contact matrix means located adjacent the ballot card and in parallel relation thereto, and including an insulated board, a plurality of parallel, electrically conductive column strips affixed to one face of said board, and a plurality of parallel, electrically conductive row strips affixed to the other face of said board, said board and said column and row strips being perforated therethrough with holes located at points corresponding to areas of overlap of said column strips and said row strips;

hand-held stylus means insertable in any selected one of said holes, and including card-punching means movable through said selected hole to punch the ballot card, first contact means, for contacting the column strip at said selected hole, second contact means, for contacting the row strip at said selected hole, said first and second contact means being electrically connected, whereby an appropriate pair of said column and row strips is electrically connected as the card is punched by said card-punching means; and electrical interface means connected with said column strips and said row strips, for generating therefrom encoded electrical signals indicative of the row and column of said selected hole.

8. Vote-recording apparatus as set forth in claim 7, wherein said electrical interface means includes:

distribution means for applying a signal to each of said strips in turn in one of said pluralities of row and column strips;

scanning means for detecting said applied signal by scanning the other of said pluralities of row and column strips, and thereby detecting a cross-contact between one of said row strips and one of said column strips;

means operative on the detection of a cross-contact, for terminating operation of said distribution means and said scanning means and thereby preserving row and column numbers indicative of the location of the cross-contact;

means for transmitting the row and column numbers for tallying of the voter selections; and means for reactivating said distribution means and said scanning means.

9. Vote-recording apparatus as set forth in claim 8, and further including ballot card sensing means, for generating an electrical signal indicative of the presence of a ballot card, whereby voter selections may be excluded from a tally of votes if the ballot card is removed before all sections are made.

10. Vote-recording apparatus as set forth in claim 9, and further including:

manual switch means manually operable to indicate that all voter selections have been completed; and means for sensing actuation of said manual switch means for utilization with said row and column numbers.

11. Vote-recording apparatus as set forth in claim 10, and further including display means operable to indicate that the voter selections have been successfully transferred through said electronic interface means.

12. Vote-recording apparatus as set forth in claim 7, wherein:

said card-punching means includes a central rod with a free end insertable in a selected one of said holes and a handle end for manipulation by a voter;

one of said first and second contact means includes an electrically conductive inner sleeve slidingly fitted to said rod and movable through said selected hole to contact one of said row and column strips;

the other of said first and second contact means includes an electrically conductive outer sleeve mounted for sliding movement over said inner sleeve and said rod; and said stylus means further includes resilient means for urging said inner and outer sleeves toward said free end of said rod and into contact with their respective row and column strips as said rod is inserted in said selected hole, and sleeve-retaining means to retain said inner and outer sleeves on said rod as one assembly;

whereby said stylus means is operated by inserting said rod and said inner sleeve in the selected hole until said outer sleeve contacts one of said row and column strips, and then depressing said rod further against said resilient means, until said inner sleeve contacts the other of said row and column strips and said rod pierces the ballot card.

13. For use in an electronic balloting system, vote-recording apparatus for simultaneously producing punched holes in a ballot card and electrical signals indicative of voter selections, said apparatus including:

means for holding a ballot card for punching;

electrical contact matrix means located adjacent the ballot card and in parallel relation thereto, and including an insulated board having a first face, furtherst from the ballot card, and a second face adjacent the ballot card, a plurality of parallel, electrically conductive column strips affixed to said first face of said board; and a plurality of parallel, electrically conductive row strips affixed to said second face of said board, said board and said strips having holes therethrough located at areas of overlap of said column and row strips, said holes having a reduced diameter at said row strips to form an annular ledge in each hole;

portable stylus means insertable in any selected one of said holes and including a generally cylindrical outer body, with an open end, a punch-rod centrally and rigidly mounted in said outer body and extending from said open end, an inner contact sleeve slidingly fitted to said punch-rod and sized to fit said holes and to contact one of said annular ledges formed by said row strips, an outer contact sleeve slidingly fitted over said inner sleeve and in said outer body, said outer sleeve protruding from said outer body, said inner sleeve, protruding from said outer sleeve, said punch-rod protruding from said inner sleeve, and said inner and outer sleeves being electrically connected, and resilient means to prevent removal of said outer sleeve from said outer body, and said inner sleeve from said outer sleeve, first resilient means mounted between said outer body and said inner sleeve to urge said inner sleeve and said outer sleeve outwardly from said open end, second resilient means mounted between said inner sleeve and said outer sleeve to urge said inner sleeve inwardly with respect to said outer sleeve, thereby resisting said first resilient means, whereby said stylus means is operated by inserting said punch-rod and said inner sleeve in said selected hole until said outer sleeve contacts said column strip, then depressing said outer body against said first and second resilient means until said punch-rod pierces the ballot card and said first resilient means overcomes said second resilient means and urges said inner sleeve into contact with said row strip; and electrical interface means connected with said column and row strips, for generating therefrom encoded electrical signals indicative of the row and column of said selected hole, said electrical interface means including distribution means for applying a signal to each of said strips in turn of one of said pluralities of row and column strips, scanning means for detecting said applied signal by scanning the other of said pluralities of row and column strips, and thereby detecting an electrical contact between one of said row strips and one of said column strips, means operative on the detection of a contact by said scanning means, for terminating operation of said distribution means and said scanning means and thereby preserving row and column numbers indicative of the location of the contact, means for transmitting the row and column numbers for tallying of the voter selections, and means for reactivating said distribution means and said scanning means.

14. Vote-recording apparatus as set forth in claim 13, and further including ballot card sensing means, for generating an electrical signal indicative of the presence of a ballot card whereby voter selections may be excluded from a tally of votes if the ballot card is removed before all selections are made.

15. Vote-recording apparatus as set forth in claim 14, and further including:

manual switch means operable to indicate that all voter selections have been completed; and means for sensing actuation of said manual switch means, for utilization with said row and column numbers.

16. Vote-recording apparatus as set forth in claim 15, and further including indicator means operable to indicate that the voter selections have been successfully transferred through said electronic interface means.

17. For use with an electronic balloting system, apparatus for simultaneously punching a card and generating a corresponding electrical signal, said apparatus comprising:

electrical contact matrix means, including an insulated board perforated with a plurality of holes corresponding to available voter selections, a like plurality of first contact elements affixed to one face of said board adjacent said holes, a like plurality of second contact elements affixed to the other face of said board and protruding slightly into said holes; and portable voting stylus means, including a punch-rod insertable through any selected one of said holes to punch a ballot card locatable beyond said electrical contact matrix means, a first contact sleeve slidingly mounted with respect to said punch-rod, for contacting one of said first contact elements, a second contact sleeve slidingly mounted with respect to said punch-rod and said first contact sleeve, for contacting one of said second contact elements on insertion in the selected hole and depression of said punch-rod, said first and second contact sleeves being electrically connected, resilient means urging said first and second contact sleeves into contact with said first and second contact elements, respectively, as said punch-rod is moved to punch the ballot card.

18. Apparatus as set forth in claim 17, wherein said resilient means includes:

first resilient means for urging said first contact sleeve into contact with said selected first contact element; and second resilient means located between said first and second contact sleeves, for opposing the force of said first resilient means on said second contact sleeve until said punch-rod has moved a predetermined distance, whereby said second contact sleeve does not make contact with said selected second contact element until said punch-rod pierces the ballot card.

* * * * *